United States Patent [19]

Görike

[11] Patent Number: 4,466,117

[45] Date of Patent: Aug. 14, 1984

[54] MICROPHONE FOR STEREO RECEPTION

[75] Inventor: Rudolf Görike, Vienna, Austria

[73] Assignee: AKG Akustische u.Kino-Geräte Gesellschaft mbH, Austria

[21] Appl. No.: 441,158

[22] Filed: Nov. 12, 1982

[30] Foreign Application Priority Data

Nov. 19, 1981 [AT] Austria ..... 4987/81

[51] Int. Cl.[3] ..... H04H 5/00

[52] U.S. Cl. ..... 381/26; 381/27; 381/111; 179/139

[58] Field of Search ..... 381/1, 26, 27, 71, 83, 381/92, 95, 111, 122; 179/121 R, 139, 179, 150, 152, 100.4

[56] References Cited

U.S. PATENT DOCUMENTS

| | | | |
|---|---|---|---|
| 2,927,963 | 3/1960 | Jordan et al. | 381/26 X |
| 3,255,317 | 6/1966 | Nakanishi | 381/26 X |
| 4,072,821 | 2/1978 | Bauer | 381/26 X |
| 4,206,324 | 6/1980 | Horikawa et al. | 381/26 X |

OTHER PUBLICATIONS

"Stereo Microphone Techniques", Burstein, Electronics World, Mar. 1960, pp. 66, 67, 126.

*Primary Examiner*—R. J. Hickey
*Attorney, Agent, or Firm*—McGlew and Tuttle

[57] ABSTRACT

A microphone for receiving acoustic vents stereophonically in accordance with a center-side method comprises a plurality of transducers including at least one having a unilateral directional characteristic particularly cardioid or hypercardioid and at least two other electroacoustic transducers having a figure-eight characteristic which are associated with the unidirectional characteristic transducer and have principal axes at right angles to the main axes of the unidirectional transducer. A common line connects a terminal of each of the three transducers and a connecting line interconnects a respective terminal of each. In addition, the connecting line between the two electroacoustic transducers having a figure-eight characteristic include control means comprising either a switch or a controller.

7 Claims, 8 Drawing Figures

MICROPHONE FOR STEREO RECEPTION

FIELD AND BACKGROUND OF THE INVENTION

This invention relates in general to transducers and in particular to a new and useful microphone arrangement for receiving acoustic events stereophonically in accordance with the center side method.

Of the many microphone arrangements which are suitable for the center/side method, the most employed ones are those combined of an electroacoustic transducer having a cardioid pattern and a transducer having a figure-eight pattern. In such a combination, the median microphone points straight forward (0°) and the figure-eight microphone points at a right angle thereto (90°). To obtain from this combination the xy signals (i.e. the signals for the left and right channels), a matrix circuit is needed. This may be a transformer, or a passive or active electronic matrix circuitry, which is clearly an additional expenditure. The need for electric voltage supply is also disadvantageous.

SUMMARY OF THE INVENTION

The invention is directed to a microphone of the above-mentioned kind performing the same function without the additional costs of a matrix circuit and being of substantially simpler design.

In accordance with the invention a plurality of electroacoustic transducers are provided on the microphone which include one having a unidirectional characteristic and two others which have a figure-eight characteristic which have principal axes of right angles to the main axis of the unidirectional characteristic transducer. A common line interconnects one terminal of each of the transducers and a connecting line connects a respective other terminal of each of the transducers and the ones having the figure-eight characteristic have control means therein comprising either a switch or a controller.

Such a stereo microphone has the advantage that to obtain the xy signals, neither a transformer nor an electronic matrix circuitry requiring power supply are needed.

In a preferred embodiment, all the transducers in the microphone are of the electrodynamic, particularly moving coil, type. This offers the advantageous possibility of adjusting most various symmetrical or asymmetrical stereo reception angles by means of switches and/or controllers connected between the output wires.

In accordance with another feature of the invention, the switches or controllers connected between the output wires of the individual transducers of the microphone are designed as slides which are disposed on the microphone in closely adjacent positions. This facilitates their actuation with a single thumb, so that the other hand remains free. Due to the low impedance of electrodynamic transducers, and with the three wires extending from the stereo microphone in accordance with the invention, the switches or controllers needed for adjusting the stereo reception angle may also be provided on the end remote from the microphone of the microphone cable, so as to be able to adjust the reception angle by remote control.

To keep the level of the stereo signals constant with a varying stereo base angle, further controllers may be provided which again may be intercoupled. It has proved advantageous to connect a variable resistor in parallel to the transducer having a unidirectional characteristic, in order to control the amplitude of the median signal.

Accordingly, it is an object of the invention to provide an improved microphone for receiving acoustic events stereophonically in accordance with the center side method.

A further object of the invention is to provide a microphone which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
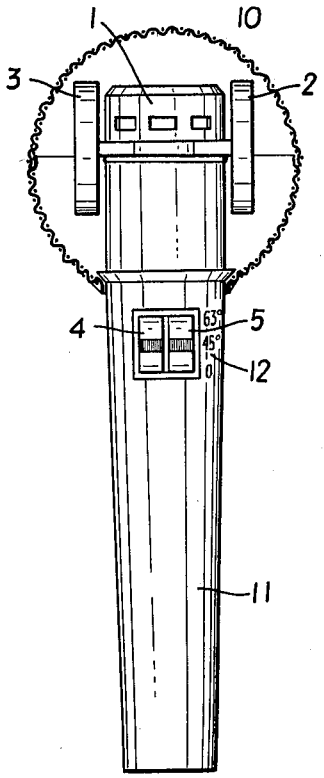
FIG. 1 is a front elevational view of a microphone constructed in accordance with the invention.

Referring to the drawings in particular the invention embodied therein comprises a microphone for receiving acoustic events sterephonically in accordance with a center side method which comprises a plurality of electroacoustic transducers including one which has a unilateral particularly cardioid or hypercardioid directional characteristic 1 and two electroacoustic transducers 2 and 3 which have figure-eight characteristic with a principal axis which is at right angles to the main axis of the transducer 1 which has the unidirectional characteristic.

It is evident from the back view of the inventive microphone shown in FIG. 1 that transducer 1 having a cardioid characteristic is designed as an extension of a handle 11. This is the most customary arrangement. Other designs, such as without handles, are also within the scope of the invention, of course.

At either side of transducer 1 having a unidirectional characteristic, a transducer 2 and 3 with a figure-eight pattern is provided of which the principal axis is perpendicular to the main axis of transducer 1. As usual, transducers 1,2 and 3 are surrounded by a wind screen 10. In the upper part of handle 11, two controllers 4,5 in the form of variable resistors are disposed side by side, so that they may be actuated simultaneously and single-handedly by the operator's thumb. A graduation 12 provided adjacent slide controllers 4 and 5 indicates the stereo angle-just set. If it is not necessary to adjust asymmetric directional patterns, i.e. such ones having their principal axis at an angle with the main axis of transducer 1, which is the case if a hand microphone is concerned which can simply be pointed by the operator in the desired direction, it is sufficient to provide control resistors 4 and 5 with a single, common actuating element.

Figure 4:
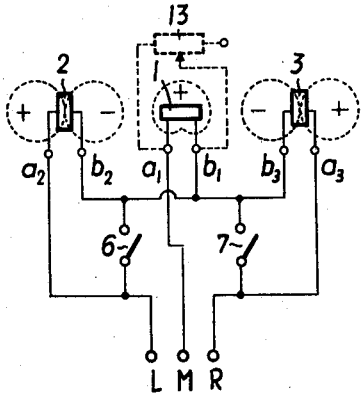
FIG. 4 is a diagram showing interconnection of the transducer outputs in accordance with one embodiment of the invention.

The space thus saved may be used for another variable resistor, shown, for example, in FIG. 4 at 13 in broken lines, which is connected in parallel to transducer 1 having a unidirectional characteristic. By means of this resistor, the median stereophonic region may be attenuated.

Figure 2:
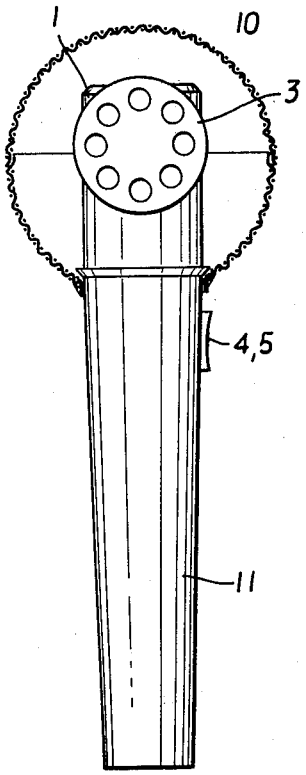
FIG. 2 is a side elevational view of the microphone shown in FIG. 1.
Figure 3:
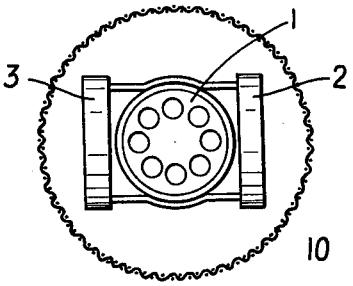
FIG. 3 is a top plan view of the microphone shown in FIG. 1.

FIGS. 2 and 3 show that in spite of the use of two additional transducers 2 and 3 at the two sides of transducer 1, the overall volume of the microphone is not disadvantageously increased and, in practice, is determined only by the volume of the wind screen 10.

Figure 5:
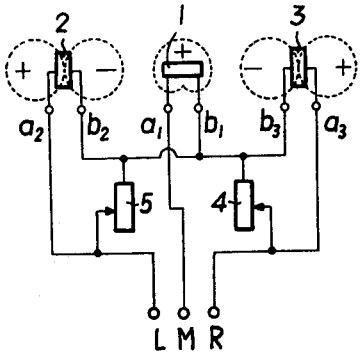
FIG. 5 is a diagram similar to FIG. 4 of another embodiment of the invention.
Figure 6:
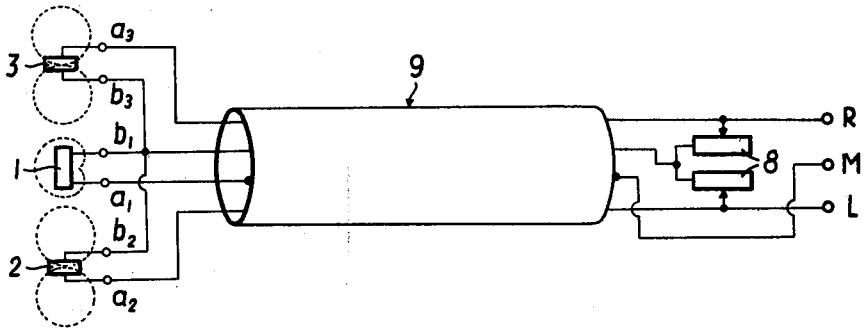
FIG. 6 is a diagrammatic illustration of an arrangement permitting the adjustment of the stereo reception angle by remote control.
Figure 7:
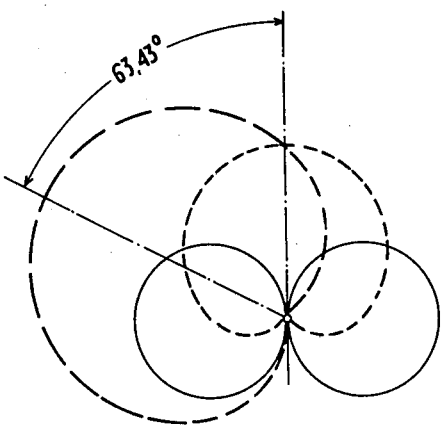
FIGS. 7 and 8 are directional pattern combinations which have been chosen to explain the possibilities of adjustment.
Figure 8:
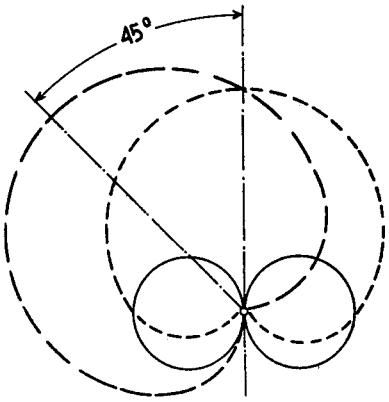

Preferably, electrodynamic transducers, especially moving coil transducers, are employed in the inventive construction. for frequencies up to about 3,000 Hz. transmitters 2 and 3 have figure-eight directional patterns, beyond this frequency, the characteristic becomes more and more lobar which is advantageous for the stereophonic transmission of sound since the stereo effect largely depends on the high frequencies. As electrodynamic transducers are employed having a low impedance, the used control resistors can remain in the low-resistance range which is favorable since it makes the arrangement insensitive to hum voltages and other interferences. With a parallel actuation of the buttons, controllers 4 and 5 make it possible to symmetrically vary the reception angle between 2°×63° and 0°. With a separate, independent actuation of the controllers 4 and 5, the principal axis of the resulting directional characterstic can be swung relative to the main axis of transducer 1 having the unidirectional characteristic. Instead of variable resistors 4 and 5, simple switches may be provided which still may be series connected with a residual resistance. The arrangement with switches is shown in FIG. 4. This diagram shows that the unified line is formed by the three single output wires of transducers 1,2,3. The other three output wires extend to the outside of the microphone, with wire $a_1$ conducting the median signal and wires $a_2$, $a_3$, the side signals. In FIG. 4, the connections of these wires are designated L,M,R. Switches 6 and 7 are provided between wires $a_2$ and $b_2$, or $a_3$ and $b_3$. With the need for a continuous variation of the received stereo signals, switches 6 and 7 will be replaced by variable resistors 4 and 5 as shown in FIG. 5. The control resistors or switches are not necessarily mounted direction at transducers, 1, 2 and 3, they may be provided at the other end of the microphone cable 9, as already mentioned and as shown in FIG. 6. A three-pole cable 9 is sufficient if the cable sheathing is used as the neutral wire. In this example, variable resistors 8 are provided. By means of controllers 4 and 5 or 8, the participation of transducers 2 and 3 having the figure-eight characteristic in the total output can be varied. If the levels of the two transducers 2 and 3 are equal to each other, the resulting stereo reception angle is 2°×63.4°, i.e. altogether about 127°, as indicated in FIG. 7. With 180° of the resulting directional pattern, a lobe is obtained having an extinction of 15 db. With the reduction of the level of the two transducers 2, 3 to one half of the level furnished by transducer 1 having the unidirectional pattern, a stereo reception angle of 2°×45° is obtained, as shown in FIG. 8.

It will be understood that other arrangements of the control resistors are also possible and that additional controllers may be provided, for example in order to obtain a constant output level for the differently adjustable directional patterns.

While specific embodiments of the invention have been shown and described in detail to illustrate the application of the principles of the invention, it will be understood that the invention may be embodied otherwise without departing from such principles.

What is claimed is:

1. A microphone for receiving acoustic events stereophonically in accordance with a center-side method comprising a plurality of electroacoustic transducers including at least one having a unilateral directional characteristic and a main axis, and at least two electroacoustic transducers having a figure-eight characteristic associated with said unilateral directional characteristic transducer and having a principal axes of right angles to said main axis, a common line interconnecting a terminal of each of said unidirectional characteristic transducer and said electroacoustic transducers having a figure-eight characteristic, each of said transducers having an associated outlet, a connecting line connecting each of said outlets, and control means in said connecting line between the outlet of said two electroacoustic transducers having a figure-eight characteristic.

2. A microphone according to claim 1, wherein said control means comprises a switch.

3. A microphone according to claim 1, wherein said control means comprises a controller.

4. A microphone according to claim 1, wherein all of said transducers are electrodynamic transducers particularly moving coil systems.

5. A microphone according to claim 1, wherein said control means comprises at least one of a switch, a controller for each connecting line, each of said transducers having figure-eight characteristics comprising at least one of a slide switch and a slide controller, said microphone including a handle portion with said controller located thereon.

6. A microphone according to claim 1, wherein said microphone includes a cable portion, said control means being provided on said cable portion on the end thereof remote from said microphone.

7. A microphone according to claim 1, including a variable resistor connected to said unilateral directional characteristic transducer.

* * * * *